US008028946B2

(12) United States Patent
Vuorio

(10) Patent No.: US 8,028,946 B2
(45) Date of Patent: Oct. 4, 2011

(54) REFINER

(75) Inventor: Petteri Vuorio, Valkeakoski (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 12/745,491

(22) PCT Filed: Nov. 24, 2008

(86) PCT No.: PCT/FI2008/050680
§ 371 (c)(1),
(2), (4) Date: May 28, 2010

(87) PCT Pub. No.: WO2009/068739
PCT Pub. Date: Jun. 4, 2009

(65) Prior Publication Data

US 2010/0314476 A1 Dec. 16, 2010

(30) Foreign Application Priority Data

Nov. 30, 2007 (FI) ..... 20075862

(51) Int. Cl.
*B02C 7/12* (2006.01)

(52) U.S. Cl. ..... 241/261.1; 241/261.3; 241/298
(58) Field of Classification Search ..... 241/261.1, 241/261.2, 261.3, 296, 297, 298
See application file for complete search history.

(56) References Cited

U.S. PATENT DOCUMENTS

| | | | |
|---|---|---|---|
| 1,131,272 | A | 3/1915 | Reynolds |
| 4,712,745 | A | 12/1987 | Leith |
| 6,032,888 | A | 3/2000 | Deuchars |
| 6,402,071 | B1 | 6/2002 | Gingras |
| 2006/0151648 | A1 | 7/2006 | Vuorio et al. |

FOREIGN PATENT DOCUMENTS

| | | | |
|---|---|---|---|
| WO | 2007085703 | A1 | 8/2007 |
| WO | 2009068739 | A1 | 6/2009 |

OTHER PUBLICATIONS

International Search Report for PCT/FI2008/050680, Mar. 2009.
Written Opinion of the International Searching Authority for PCT/FI2008/050680, Mar. 2009.

*Primary Examiner* — Mark Rosenbaum
(74) *Attorney, Agent, or Firm* — Stiennon & Stiennon

(57) ABSTRACT

A refining surface (2) of a refiner stator (4) for a refiner for defibrating lignocellulose-containing material has a feed edge (17) oriented in the direction of the feed flow of the material to be refined, and a discharge edge (16) oriented in the direction of the discharge flow of the material refined. The surface (2) has blade bars (10) with grooves (11) therebetween, and at least one dam (12) in a groove (11). The dam has an upwardly rising guiding surface (13) from the blade groove bottom (15) for guiding the material to be refined and the material already refined out of the blade groove. The upward direction of the guiding surface (13) is from the direction of the discharge edge (16) of the refining surface (2) in the direction of the feed edge (17) of the refining surface (2).

24 Claims, 5 Drawing Sheets

REFINER

CROSS REFERENCES TO RELATED APPLICATIONS

This application is a U.S. national stage application of International App. No. PCT/FI2008/050680, filed Nov. 24, 2008, the disclosure of which is incorporated by reference herein, and claims priority on Finnish Application No. FI 20075862, filed Nov. 30, 2007, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refining surface of a refiner stator for a refiner intended for defibrating lignocellulose-containing material, the refining surface comprising a feed edge oriented in the direction of the feed flow of the material to be refined, and a discharge edge oriented in the direction of the discharge flow of the material refined, and the refining surface comprising blade bars and blade grooves therebetween, and at least one dam arranged in at least one blade groove, the dam comprising at least one guiding surface, which rises upward from the direction of a bottom of the blade groove, for guiding the material to be refined and the material already refined out of the blade groove.

The invention further relates to a blade segment for a refining surface of a refiner stator for a refiner intended for defibrating lignocellulose-containing material, the blade segment being configurable to constitute part of the entire refining surface of the refiner stator and the blade segment comprising a refining surface comprising a feed edge oriented in the direction of the feed flow of the material to be refined, and a discharge edge oriented in the direction of the discharge flow of the material refined, and the refining surface comprising blade bars and blade grooves therebetween, and a dam arranged in at least one blade groove, the dam comprising at least one guiding surface, which rises upward from the direction of a bottom of the blade groove, for guiding the material to be refined and the material already refined out of the blade groove.

The invention further relates to a refiner for defibrating lignocellulose-containing material, the refiner comprising at least one stator and at least one rotor.

Refiners for making mechanical pulp typically comprise two or more oppositely situated refiner elements that rotate with respect to each other. A fixed, i.e. stationary, refiner element is called a refiner stator and a rotating or rotatable refiner element is called a refiner rotor. In disc refiners, the refiner elements are disc-like and in cone refiners, the refiner elements are conical. In addition to disc refiners and cone refiners, also so-called disc-cone refiners exist, wherein disc-like refiner elements are first arranged in the flow direction of the material to be defibrated, followed by additional refining of the material to be defibrated between the conical refiner elements. Furthermore, cylinder refiners also exist, wherein both the refiner stator and the rotor are cylindrical refiner elements. The refining surfaces of refiner elements are composed of blade bars, i.e. bars, and blade grooves, i.e. grooves, therebetween. The blade bars serve to defibrate the lignocellulose-like material, and the blade grooves serve to convey both the material to be defibrated and that already defibrated on the refining surface. In disc refiners, which are the commonest refiner type, the material to be refined is usually fed to the middle of the stator, i.e. through an opening on the inner circumference of the refining surface of the stator, in between the refining surfaces of the refiner discs, i.e. into a blade gap. The material refined is discharged from the blade gap from the outer circumference of the refining surfaces of the refiner discs to be fed forward in the pulp production process. The refining surfaces of the refiner discs may be either directly formed in the refiner discs or they may be composed of separate blade segments placed adjacent with respect to each other in such a manner that each blade segment constitutes part of the integral refining surface.

Usually, dams connecting two adjacent blade bars are situated in places on the bottom of the blade grooves of the refining surfaces of both the refiner stator and the rotor. The dams serve to guide the material to be refined and the material already refined in between the blade bars of opposite refining surfaces for further refining. The dams include at least one guiding surface that rises upward from the direction of the bottom of the blade groove and whose upward direction is from the direction of the feed edge of the refining surface, i.e. from the edge of the refining surface oriented in the direction of the feed flow of the material to be refined in the direction of the discharge edge of the refining surface, i.e. in the direction of the edge of the refining surface oriented in the direction of the discharge flow of the material refined. Said guiding surface lifts both material to be refined and material already refined out of the blade groove in between opposite refining surfaces. Viewed from the direction of the discharge edges of the refining surfaces, the guiding surfaces of the dams usually end in a vertical surface in such a manner that the material refined and passed the dam can no longer flow backward towards the feed direction of the material to be refined.

Since the dams guide the material to be refined in between opposite blade bars, the dams allow the refining of the material to be enhanced. However, at the same time the dams prevent the passage of the material to be refined on the refining surface by restricting the cross-sectional area of the flow of the blade grooves. This, in turn, generates blockages on the refining surface, which again cause a decrease in the production capacity of the refiner and non-uniformity of the quality of the material refined. This problem is associated particularly with the refining surfaces of refiner stators, since the stationary blade bars of the refining surface of a stationary refiner stator do not exert any special force effect on the material to be refined, which would enhance the passage of the material to be refined in the blade grooves of the refining surface of the refiner stator.

SUMMARY OF THE INVENTION

The object of the present invention is to provide a new type of refining surface for a refiner stator.

The refining surface of the invention is characterized in that the upward direction of the guiding surface of at least one dam in the refining surface is from the direction of the discharge edge of the refining surface in the direction of the feed edge of the refining surface.

The blade segment of the invention is characterized in that the upward direction of the guiding surface of at least one dam in the refining surface of the blade segment is from the direction of the discharge edge of the refining surface of the blade segment in the direction of the feed edge of the refining surface of the blade segment.

A refining surface of a refiner stator intended for defibrating lignocellulose-containing material comprises a feed edge oriented in the direction of the feed flow of the material to be refined, and a discharge edge oriented in the direction of the discharge flow of the material refined. The refining surface comprises blade bars and blade grooves therebetween, and at least one dam arranged in at least one blade groove, the dam comprising at least one guiding surface, which rises upward from the direction of the bottom of the blade groove, for guiding the material to be refined and the material already refined out of the blade groove. Furthermore, the upward direction of the guiding surface of at least one dam is from the discharge edge of the refining surface in the direction of the feed edge of the refining surface.

An advantage of the solution is that, since in practice, the direction of the guiding surface of the dam of the refining surface of the stator as described corresponds to the practically detected flow direction of the fibers already refined or the material still to be refined on the refining surface of the stator, the number of blockages caused by fibers on the refining surface is reduced, which further helps keep the production capacity of the refiner high and the quality of the material refined uniform.

According to an embodiment, the upward direction of the guiding surface of more than one dam in the refining surface is from the direction of the discharge edge of the refining surface in the direction of the feed edge of the refining surface.

According to another embodiment, the refining surface is the refining surface of the stator of a high-consistency refiner and comprises one or more dams having a guiding surface whose upward direction is from the direction of the discharge edge of the refining surface in the direction of the feed edge of the refining surface in such a manner that said dam or said dams are arranged between the turning point of steam generated during the refining and the feed edge of the refining surface.

According to a third embodiment, the refining surface is a refining surface in a stator of a low-consistency pulp refiner and comprises one or more dams having a guiding surface whose upward direction is from the direction of the discharge edge of the refining surface in the direction of the feed edge of the refining surface and that said dam or said dams are arranged in a portion on the side of the discharge edge of the refining surface.

Some embodiments of the invention will be described in more detail in the accompanying drawings.

BRIEF DESCRIPTION OF THE DRAWINGS

In the figures, some embodiments of the invention are shown in a simplified manner for the sake of clarity. In the figures, like parts are denoted with like reference numerals.

DESCRIPTION OF THE PREFERRED EMBODIMENTS

Figure 1:
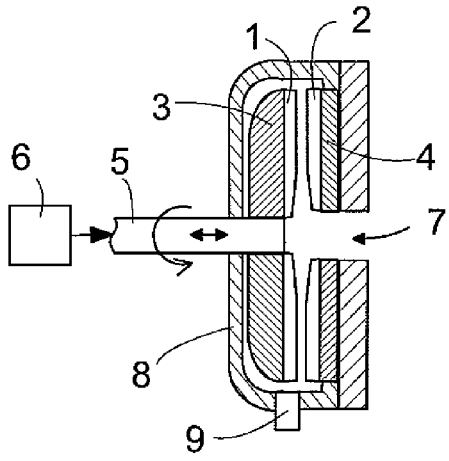
FIG. 1 schematically shows a cross-sectional side view of a conventional disc refiner.

FIG. 1 schematically shows a cross-sectional side view of a conventional disc refiner. The disc refiner of FIG. 1 comprises two disc-like refining surfaces 1 and 2 arranged mutually coaxially. The first refining surface 1 is in a rotating refiner element 3, i.e. in the refiner rotor 3, and the second refining surface 2 is in a stationary refiner element 4, i.e. in the refiner stator 4. The refining surfaces 1 and 2 of the refiner elements 3 and 4 may be formed directly therein or formed from separate blade segments in a manner known per se. The refiner rotor 3 is rotated via a shaft 5 in a manner known per se by means of a motor, which is not shown for the sake of clarity. In connection with the shaft 5 is arranged also a special loading device 6 connected to act via the shaft 5 on the rotor 3 in a manner allowing the rotor 3 to be pushed towards the stator 4 for adjusting the gap therebetween, i.e. the refiner gap.

The lignocellulose-containing material to be defibrated is fed from an opening 7 in the middle of the second refining surface 2 to the refiner gap between the refining surfaces 1 and 2, wherein it is defibrated and refined. The lignocellulose-containing material to be defibrated may also be fed to the refiner gap from openings in the second refining surface 2, which are not shown in FIG. 1 for the sake of clarity. The defibrated lignocellulose-containing material is discharged from between the refiner discs 3 and 4 from the outer edge of the refiner gap into a refiner chamber 8 and further out of the refiner chamber 8 along a discharge channel 9.

Figure 2:
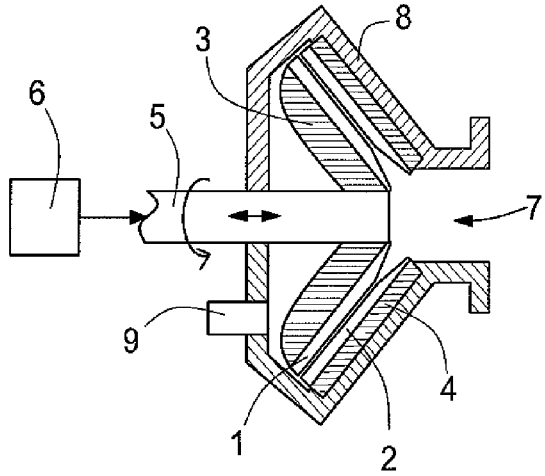
FIG. 2 schematically shows a cross-sectional side view of a conventional cone refiner.

FIG. 2 schematically shows a cross-sectional side view of a conventional cone refiner. The cone refiner of FIG. 2 comprises two conical refining surfaces 1 and 2 placed nested mutually coaxially. The first refining surface 1 is in a rotating conical refiner element 3, i.e. in the refiner rotor 3, and the second refining surface 2 is in a stationary conical refiner element 4, i.e. in the refiner stator 4. The refining surfaces 1 and 2 of the refiner elements 3 and 4 may be either directly formed therein or they may be composed of separate blade segments in a manner known per se. The refiner rotor 3 is rotated via a shaft 5 in a manner known per se by means of a motor, which is not shown for the sake of clarity. In connection with the shaft 5 is arranged also a special loading device 6 connected to act via the shaft 5 on the rotor 3 in a manner allowing the rotor 3 to be pushed towards the stator 4 for adjusting the gap therebetween, i.e. the refiner gap.

The lignocellulose-containing material to be defibrated is fed from an opening 7 in the middle of the second refining surface 2 to the conical refiner gap between the refining surfaces 1 and 2, wherein it is defibrated and refined. The defibrated lignocellulose-containing material is discharged from between the refiner elements 3 and 4 from the outer edge of the refiner gap into a refiner chamber 8 and further out of the refiner chamber 8 along a discharge channel 9.

In addition to disc refiners and cone refiners, also so-called disc-cone refiners exist, wherein disc-like refiner elements are first arranged in the flow direction of the material to be defibrated, followed by additional refining of the material to be defibrated between the conical refiner elements. Furthermore, cylinder refiners also exist, wherein both the refiner stator and the rotor are cylindrical refiner elements. The general structural and operational principles of different refiners are known per se to a person skilled in the art, and they will therefore not be dealt with in any more detail in this context.

Figure 3:
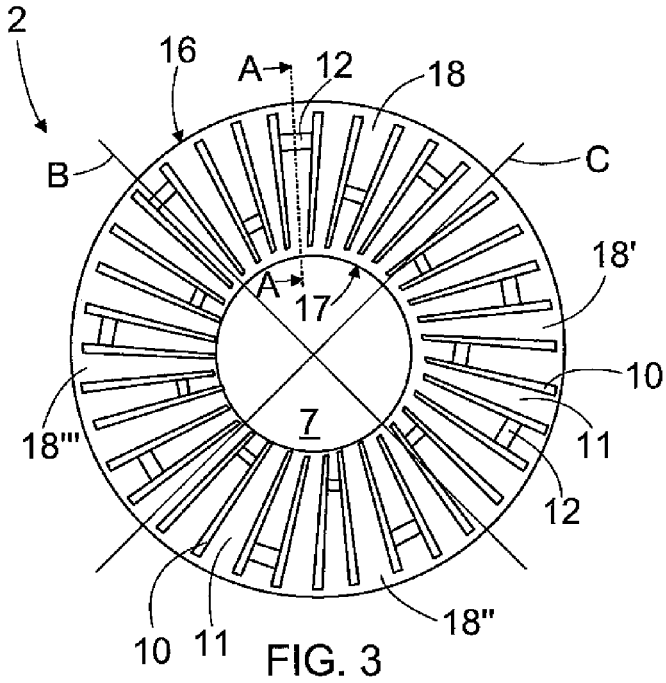
FIG. 3 schematically shows a general view of the refining surface of a refiner stator viewed in the direction of the refining surface.
Figure 4:
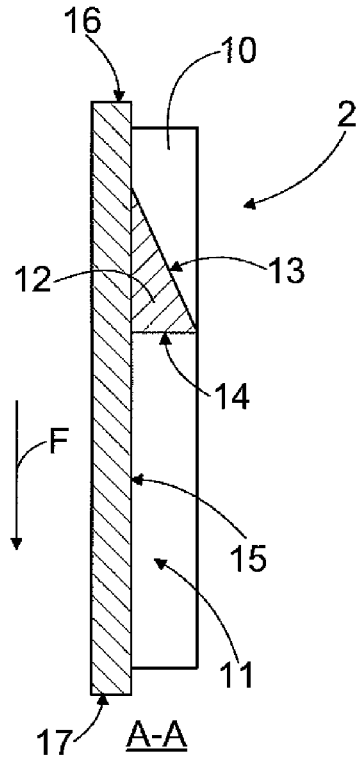
FIG. 4 schematically shows a cross-sectional side view of the refining surface of FIG. 3.

FIG. 3 schematically shows a general view of a refining surface 2 of a refiner stator 4 viewed in the direction of the refining surface 2, and FIG. 4 schematically shows a cross-sectional side view of the refining surface according to FIG. 3, shown along the cross-sectional line A-A of FIG. 3. The refining surface 2 comprises alternately blade bars 10 and blade grooves 11 therebetween in the circumferential direction of the refining surface 2. The blade bars serve to defibrate the lignocellulose-containing material, and the blade grooves serve to convey both material to be defibrated and material already defibrated on the refining surface. The refining surface 2 also comprises flow restrictors 12, i.e. dams 12, arranged transversely in the blade groove 11 and comprising an inclined guiding surface 13 that rises upward from a bottom 15 of the blade groove 11 and ends in a perpendicular rear portion 14 arranged in the dam and falling onto the bottom of the blade groove 11. The dams 12 serve to guide the material to be refined and the material already refined in between the blade bars 10 of the opposite refining surfaces 1 and 2 for further refining.

In the refining surface 2 of FIGS. 3 and 4, the inclined guiding surface 13 of the dam 12 is arranged to rise upward from the bottom 15 of the blade groove 11 in such a manner that upward direction of the guiding surface 13 of the dam 12 is from the direction of the discharge edge 16 of the refining surface 2, i.e. from the direction of the discharge flow of the material refined, in the direction of the feed edge 17 of the refining surface 2, i.e. in the direction of the feed flow of the material to be refined, i.e. opposite to that in conventional refiner stator refining surface solutions. This solution is based on the observation that, in practice, the fibers or the material to be defibrated moves on the refining surfaces 2 of the refiner stators 4 from the direction of the discharge edge 16 of the refining surface 2 in the direction of the feed edge 17 of the refining surface 2.

Thus, according to the solution, the upward direction of the guiding surface 13 of at least one dam 12 in the refining surface 2 of the stator 4 is from the direction of the discharge edge 16 of the refining surface 2 in the direction of the feed edge 17 of the refining surface 2. In some cases, the direction from the direction of the discharge edge 16 of the refining surface 2 in the direction of the feed edge 17 of the refining surface 2 can be adapted as the upward direction of the guiding surfaces 13 of all dams 12 in the refining surface 2 of the stator 4. Since this direction corresponds to the practical flow direction of the fibers or the material to be refined on the refining surface 2 of the stator 4, as schematically shown by arrow F in FIG. 4, the number of blockages caused by the fibers on the refining surface is reduced, which helps keep the production capacity of the refiner high and the quality of the material refined uniform. The more dams there are whose guiding surface has an upward direction from the direction of the discharge edge of the refining surface in the direction of the feed edge of the refining surface, the fewer blockages are generated on the refining surface of the stator and the higher the production capacity of the refiner remains and the more uniform is the quality of the material refined.

The refining surface 2 shown in FIG. 3 is directly created in the refiner disc 4, but the refining surface 2 of FIG. 3 may also be composed of blade segments 18, 18', 18" and 18'" arranged side by side relative to each other and schematically shown in FIG. 3 by means of lines B and C that divide the refining surface 2 into four portions.

Figure 5:
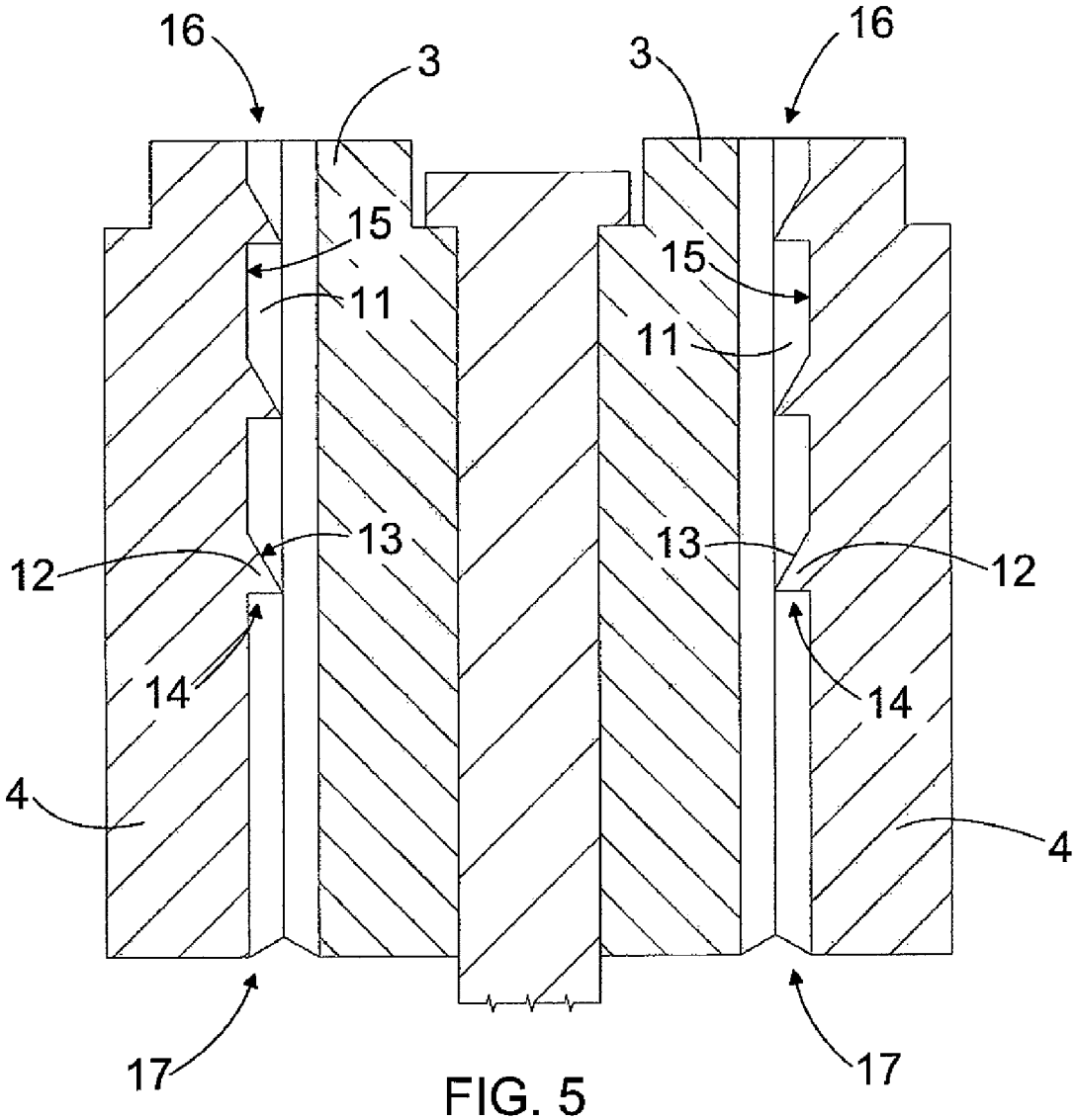
FIG. 5 schematically shows a cross-sectional side view of part of a double-disc refiner.

FIG. 5 schematically shows a cross-sectional side view of part of a double-disc refiner. The double-disc refiner of FIG. 5 comprises two stators 4 and therebetween two rotors 3 fastened to a blade fastening disc. Between the stators 4 and the rotors 3 is a blade gap, whereto the fibrous material to be refined is fed from the side of the feed edge 17 and from which blade gap the material refined is discharged from the side of the discharge edge 16. The refining surface of the refiner stator 4 is provided with dams 12 having an inclined guiding surface 13 such that the guiding surfaces 13 are arranged to rise from the direction of the discharge edge 16 of the refining surface in the direction of the feed edge of the refining surface. The guiding surface 13 ends in a rear portion 14 of the dam 12, the rear portion being perpendicular with respect to the bottom 15 of the blade groove 11.

The solution presented may be used in both high-consistency refiners, i.e. HC refiner, and in low-consistency refiners, i.e. LC refiners. In HC refiners, the consistency of the material to be refined is typically more than 25% or more than 30%. In LC refiners, the consistency of the material to be refined is typically less than 8% and often less than 5%. The solution presented may naturally also be used in medium-consistency refiners, wherein the consistency of the material to be refined is typically 8% to 25%. In the following, the special features of the solution presented will be further dealt with in association with HC refiners and LC refiners.

In HC refiners, a larger blade interval, i.e. a larger distance between the refining surfaces, is used than in LC refiners. This and the higher consistency result in a larger quantity of fibers being refined at a time in HC refining than in LC refining, and between the fibers, more inter-fiber refining occurs in HC refining than in LC refining. Due to this, HC refiners use more energy than LC refiners, which results in a large amount of steam being generated in HC refining, which has a larger requirement for space than the space requirement of the refining of LC refiners that takes place in a lower consistency and water phase. The speed of rotation of the refining surfaces of HC refiners is also higher than the speed of rotation of the refining surfaces of LC refiners. The higher circumferential speed of the refining surface of a HC refiner caused thereby with respect to that of the refining surface of an LC refiner affects the refining event in such a manner that in HC refining, the fiber material is subjected to a larger number of defibrating impacts than in LC refining. Partly for this reason, a HC refiner may be loaded more than an LC refiner may. A high load signifies a high energy consumption, a large steam generation and, furthermore, a large requirement for flow volume. Because of these differences between HC refining and LC refining, the arrangement of the upward direction of the inclined guiding surfaces of the dams in accordance with the solution presented to correspond to the actual flow direction of the fibers and the material to be refined in the blade grooves of the stator refining surface results, by way of a lower number of blockages, in more significant advantages in HC refiners than in LC refiners.

Because of the differences between HC refiners and LC refiners, the embodiments of the solution vary somewhat between HC refiners and LC refiners and, in the following, the differences between these different embodiments will be studied.

Since a large amount of water vapor is generated during refining in high-consistency refiners, a steam pressure is generated in the blade gap between the stator and rotor between the feed edge and the discharge edge that rises from the feed edge up to the turning point of the steam and drops from the turning point of the steam to the discharge edge of the blade gap. As a result, the flow of material to be refined and material already refined in the blade grooves of the refining surface of the refiner stator occurs in the blade length from the feed edge of the refining surface or the blade gap to the turning point of the steam from the direction of the discharge edge of the refining surface or the blade gap towards the feed edge of the refining surface or the blade gap, i.e. in the direction of a decreasing steam pressure. Correspondingly, said flow occurs in the blade length from the turning point of the steam to the discharge edge of the refining surface or the blade gap in the blade grooves of the refining surface of the stator from the direction of the feed edge of the refining surface or the blade gap towards the discharge edge of the refining surface or the blade gap, i.e. also in the direction of the decreasing steam pressure. Accordingly, in HC refiners, it is preferable to place dams on the distance from the feed edge of the refining surface to the turning point of the steam in one or more or even all blade grooves of the refining surface of the stator in such a manner that the upward direction of the guiding surface of the dam is from the direction of the discharge edge of the refining surface in the direction of the feed edge of the refining surface.

Figure 6:
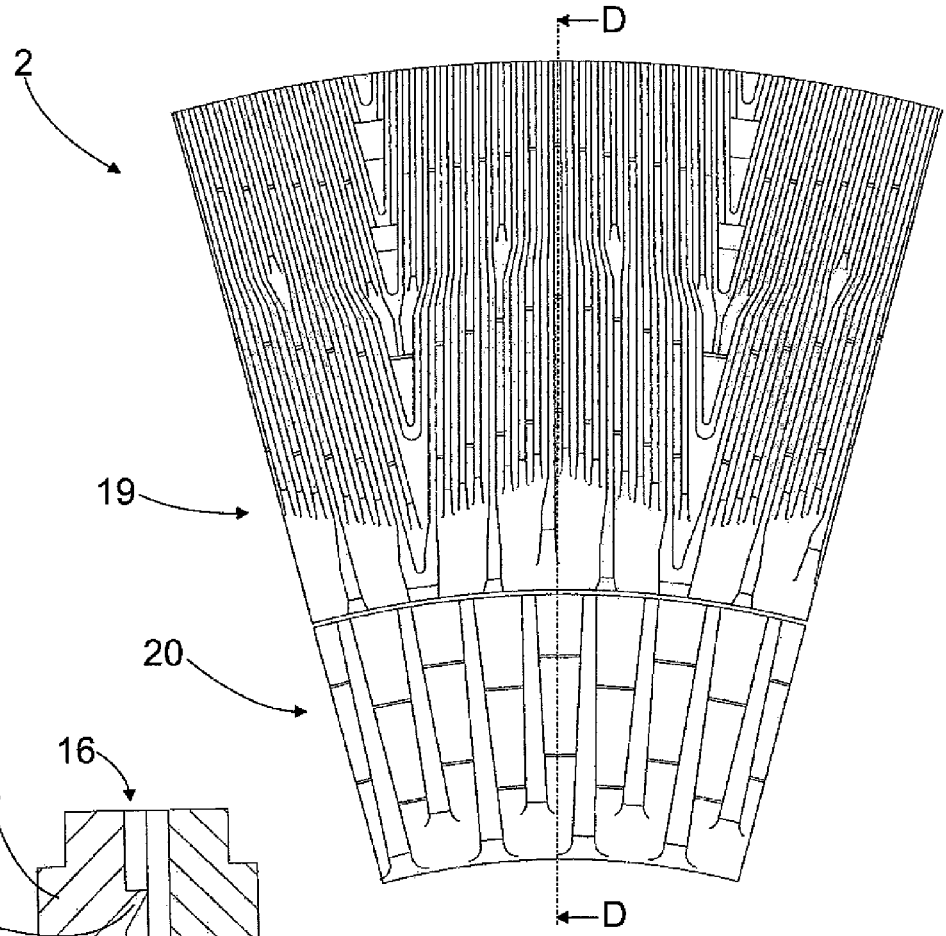
FIG. 6 schematically shows the refining surface of a stator in a high-consistency refiner viewed in the direction of the refining surface.
Figure 7:
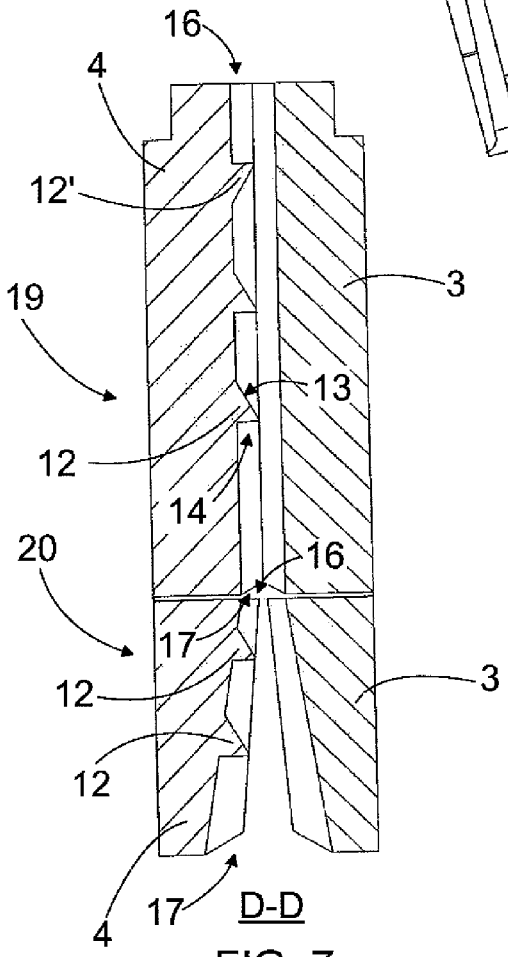
FIG. 7 schematically shows a cross-sectional side view of the refining surface of FIG. 6 also showing the rotor of the refiner.

FIG. 6 schematically shows part of the refining surface 2 of a stator in a high-consistency refiner viewed in the direction of the refining surface 2, and FIG. 7 schematically shows a cross-sectional side view of the refining surface 2 of FIG. 6 along the cross-sectional line D-D shown in FIG. 6, also showing the rotor 3 of the refiner. The high-consistency refiner shown in FIGS. 6 and 7 is a disc-type high-consistency refiner, and they typically include an inner blade block 20 or blade portion 20 or blade segment 20 placed on the side of the center of the refiner, and an outer blade block 19 or blade portion 19 or blade segment 19 placed on the side of the outer circumference of the refiner. In FIG. 6, the portions of the refining surface 2 denoted with reference numerals 19 and 20 may both be blade segments separate from one another or they may together constitute one blade segment. The turning point of the steam is located in such a manner that it is approximately halfway through the outer blade block 19, the inner blade block 20 being—so to say—entirely inside the turning point of the steam. In this case, the dams 12, the upward direction of whose guiding surface 13 is from the direction of the discharge edge 16 of the refining surface 2 of the stator in the direction of the feed edge 17 of the refining surface 2 in such a manner that such dams 12 are preferably arranged starting from the feed edge 17 of the outer blade block 19 along a length of 75% of the outer blade block 19 in the direction of the discharge edge of the outer blade block 19. More preferably, said dams 12 are arranged starting from the feed edge 17 of the outer blade block 19 along a length of 50% of the outer blade block 19 in the direction of the discharge edge of the outer blade block 19. In these cases, said dams are preferably arranged along the length of the entire inner blade block 20. FIG. 7 further shows, adjacent the discharge edge 16 of the outer blade block 19 of the refining surface 2, a conventional, previously known dam 12', wherein the upward direction of the guiding surface is from the direction of the feed edge 17 of the refining surface in the direction of the discharge edge 16 of the refining surface, which enhances the material flow in the blade groove close to the discharge edge of the refining surface, where the steam pressure sinks in the above-described manner from the turning point of the steam towards the discharge edge 16.

Figure 8:
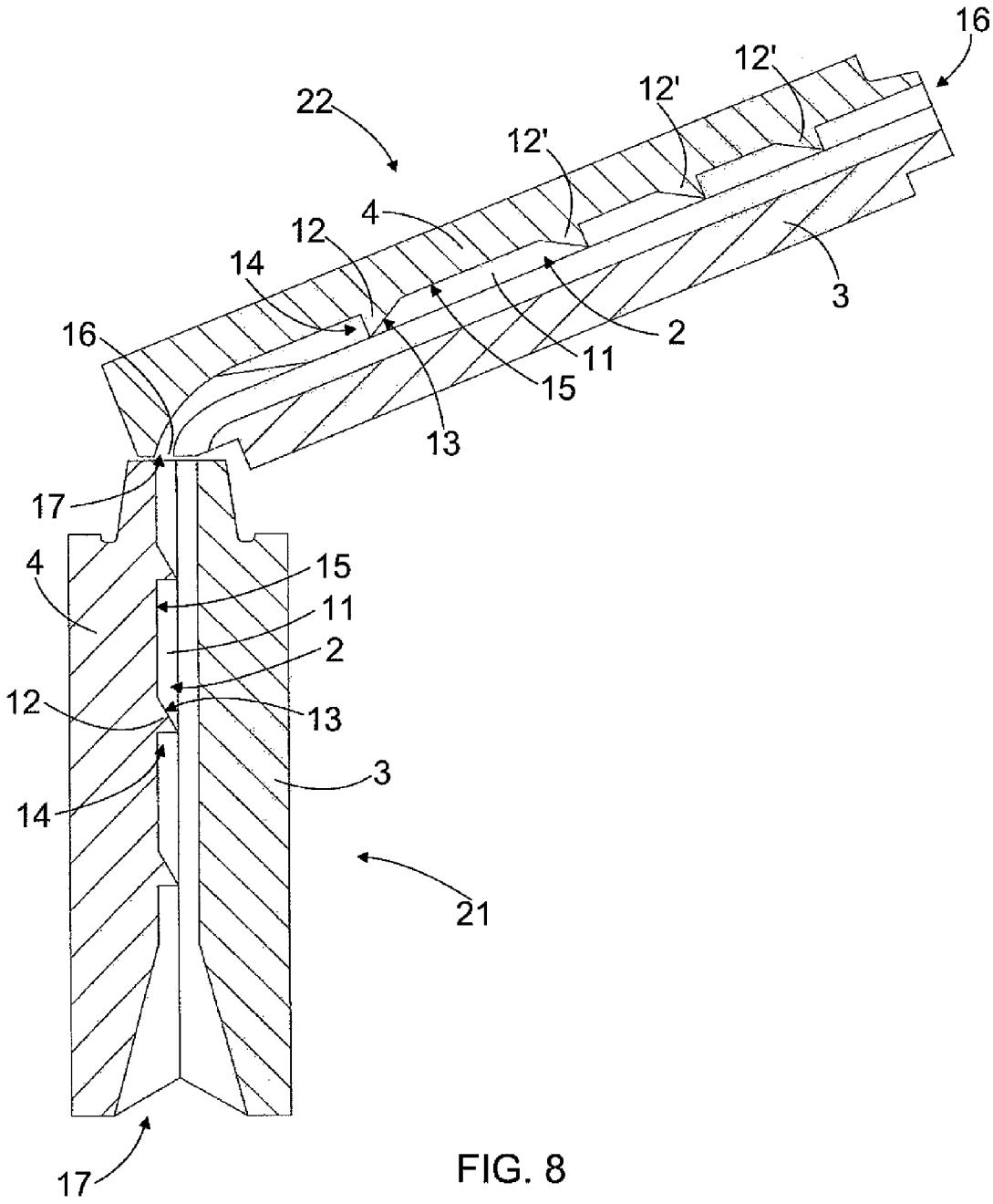
FIG. 8 schematically shows a side view of another high-consistency refiner.

FIG. 8 shows a side view of the upper part of another high-consistency refiner. The high-consistency refiner shown in FIG. 8 is a so-called conical disc refiner comprising a planar part 21 of the refiner on the side of the inner circumference of the refiner, and a conical part 22 of the refiner on the side of the outer circumference. In a high-consistency conical disc refiner, the turning point of steam is on the length of the blade block of the conical part 22 of the refiner in the immediate vicinity of the discharge edge 16 of the planar part 21 or on the length of the first part of the conical part 22 starting from the feed edge of the conical part. In this case, the dams 12, the upward direction of whose guiding surface 13 is from the direction of the discharge edge 16 of the refining surface 2 of the stator in the direction of the feed edge 17 of the refining surface 2, can be placed on the planar part 21 of the conical disc refiner in such a manner that said dams 12 are arranged on the planar part 21 preferably starting from the feed edge 17 of the planar part 21 along a length of 75% in the direction of the discharge edge 16 of the planar part 21, and more preferably on the length of the blades of the entire planar part 21. Correspondingly, the dams 12, the upward direction of whose guiding surface 13 is from the direction of the discharge edge 16 of the refining surface 2 of the stator in the direction of the feed edge 17 of the refining surface 2, can be placed on the conical part 22 of the conical disc refiner in such a manner that said dams 12 are arranged on the conical part 22 preferably starting from the feed edge 17 of the conical part 22 along a length of 50% of the conical blade length in the direction of the discharge edge 16 of the conical part 22, and more preferably, starting from the feed edge 17 of the conical part 22 on a length of 25% of the conical blade length in the direction of the discharge edge 16 of the conical part 22. FIG. 8 further shows, close to the discharge edge 16 of the conical part 22, three conventional previously known dams 12', wherein the upward direction of the guiding surface is from the direction of the feed edge 17 of the refining surface in the direction of the discharge edge 16 of the refining surface.

Figure 9:
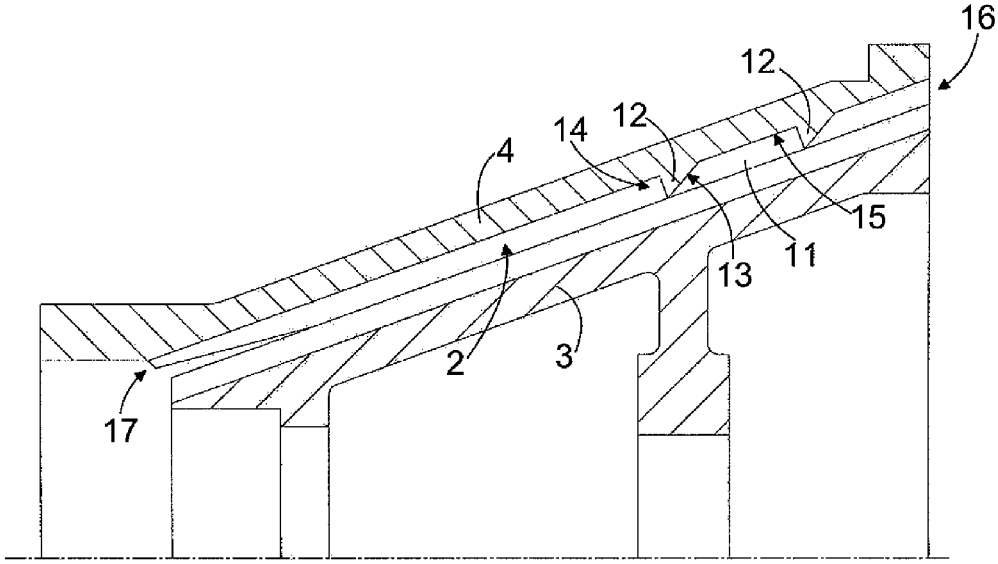
FIG. 9 schematically shows a cross-sectional side view of part of a low-consistency pulp refiner.

FIG. 9 schematically shows a side view of the upper part of a low-consistency pulp refiner. The low-consistency pulp refiner shown in FIG. 9 is a cone refiner, but may naturally have a different structure. In low-consistency pulp refiners, i.e. LC refiners, the volume of the material to be refined changes substantially less than in high-consistency refiners, since no water vaporization occurs, whereby no turning point of steam typical of high-consistency refiners is generated. Low-consistency pulp refiners may have pumping blades or non-pumping blades. Pumping blades mean that, in refiner use, the pressure increases in the blade gap from the feed edge to the discharge edge by the action of the blades. Correspondingly, non-pumping blades mean that, in refiner use, the pressure of the feed edge of the blade gap is higher than the pressure on the discharge edge of the blade gap, i.e. the pressure in the blade gap drops by the action of the blades from the feed edge to the discharge edge. Particularly in the case of pumping blades, the pressure of the discharge edge of the blade groove in the refining surface of the refiner stator or on a portion adjacent to the discharge edge, the pressure in the blade groove may become less than the pressure in the discharge space of the refiner and/or at the same point in the blade groove of the refining surface of the rotor. This results in the flow of material to be refined and already refined in the blade grooves of the refining surface of the stator being oriented, at said point or in said portion, in the blade grooves of the refiner blade of the stator or from the discharge edge of the blade gap, in the direction of the feed edge of the blade gap. In such a case, it is preferable to arrange the dams, in the refining surface of the stator on the portion of the reversed flow direction, i.e. on the portion abutting on the discharge edge of the refining surface or the blade gap, in such a manner that the upward direction of the guiding surface of the dams is from the direction of the discharge edge of the refining surface towards the feed edge of the refining surface.

In this case, the dams 12, the upward direction of whose guiding surface 13 is from the direction of the discharge edge 16 of the refining surface 2 of the stator in the direction of the feed edge 17 of the refining surface 2, may be placed on the refining surface 2 of the refiner stator such that said dams 12 are preferably along the blade length of the refining surface of the entire stator. More preferably, the dams 12 according to the solution are placed starting from the discharge edge 16 of the refining surface 2 on a length of 75% of the blade length of the refining surface in the direction of the feed edge 17 of the refining surface 2. Most preferably, said dams 12 are placed starting from the discharge edge 16 of the refining surface 2 along a length of 50% of the blade length of the refining surface 2 in the direction of the feed edge 17 of the refining surface 2. In the embodiment shown in FIG. 9, only two dams 12 are shown, but there may naturally be only one or more of them.

The refining surfaces of a stator according to FIGS. 6, 7, and 8, wherein dams are arranged from the feed edge of the refining surface to the turning point of steam, the upward directions of the guiding surfaces of which dams are from the direction of the discharge edge of the refining surface in the direction of the feed edge of the refining surface, and dams from the turning point of steam to the discharge edge of the refining surface, the upward directions of the guiding surfaces of which dams are from the direction of the feed edge of the refining surface in the direction of the discharge edge of the refining surface, are thus at their most preferable in high-consistency refiners. However, such refining surfaces also preferably operate in low-consistency refiners when the blade bars are, for example, suitably pumping and restraining such that a turning point of the flow of material to be refined is generated on the refining surface of the stator, the point being comparable with the turning point of steam in high-consistency refiners. Between the turning point of the flow and the feed edge, the material flow in the blade grooves of the refining surface of the stator is oriented from the turning point of the flow in the direction of the feed edge. Between the turning point of the flow and the discharge edge, the material flow taking place in the blade grooves of the refining surface of the stator is oriented from the turning point of the flow in the direction of the discharge edge. Such a flow state may take form in the blade grooves of the refining surface of the stator for instance when the blades are pumping from the feed edge of the blades to the turning point of the flow, and retaining from the turning point of the flow to the discharge edge of the refining surface. By the action of pumping blades, the pressure in the blade grooves of the refining surface of the rotor may thus rise higher than the pressure in the blade grooves at the corresponding point of the stator in a manner causing a reversed flow in the blade grooves of the refining surface of the stator. Correspondingly, retaining blades between the turning point of the flow and the discharge edge may further lead to a situation where the pressure in the blade grooves of the refining surface of the rotor relative to the pressure in the blade grooves at the corresponding point of the stator becomes suitable such that the combined action of the pressure generated up to the turning point of the blade gap and the retaining blades makes the flow in the blade grooves of the refining surface of the stator in the portion between the turning point of the flow and the discharge edge take place from the turning point of the flow in the direction of the discharge edge.

Figure 10:
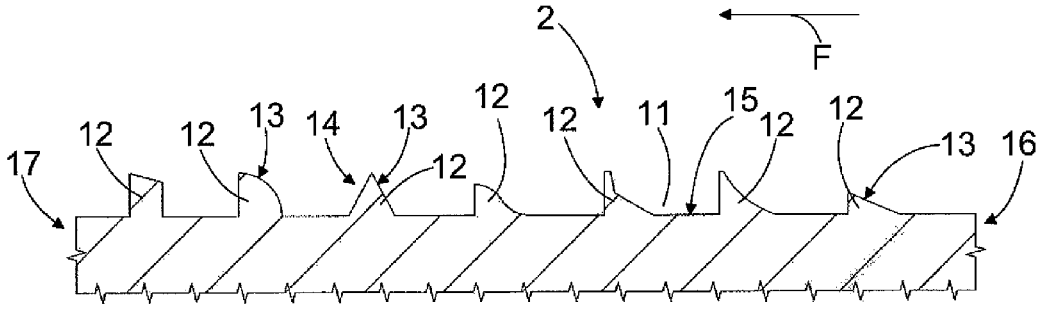
FIG. 10 schematically shows a cross-sectional side view of some feasible shapes of the refining surfaces of dams, suitable for use on the refining surface of a refiner stator.

FIG. 10 schematically shows a side view of some feasible shapes of the guiding surface 13 of the dams 12, suitable for use on the refining surface 2 of a refiner stator 4. In FIG. 10, reference numeral 16 denotes the discharge edge of the refining surface 2, and reference numeral 17 the feed edge of the refining surface 2. The bottom of the blade groove 11 is denoted with reference numeral 15. The practical flow direction of material to be refined and already refined on the refining surface 2 of the stator 4 is schematically shown with arrow F. For the sake of clarity, FIG. 10 does not show the blade bar of the refining surface 2 of the stator 4 or the refiner rotor 3. Starting from the direction of the discharge edge 16 of the refining surface 2, the first dam 12 comprises a linearly rising, i.e. an inclined guiding surface 13 extending up to the bottom 15 of the blade groove 11 in such a manner that the guiding surface 13 rises linearly at a constant angle starting from the bottom 15 of the blade groove. At the same time, it also means that the inclined guiding surface 13 rises linearly from the direction of the bottom 15 of the blade groove 11. The guiding surface 13 may rise to the middle to the height of the blade bar, for example. The rear part 14 of the dam 12 is, in turn, perpendicular with respect to the bottom 15 of the blade groove 11.

The guiding surface 13 of the following dam 12 rises along a concave motion path and starts from the bottom 15 of the blade groove 11. The guiding surface 13 according to the concave motion path ends in a bar part of the dam, the bar part being parallel with the bottom 15 of the blade groove 11, the bar part, in turn, ending in a rear part 14 of the dam 12, the rear part being perpendicular with respect to the bottom 15 of the blade groove 11.

The guiding surface 13 of the following dam 12 comprises two linearly rising portions. The first portion of the guiding surface 13 rises starting from the bottom 15 of the blade groove 11 linearly at a constant angle and is followed by a second portion, which also rises at a constant angle, but whose angle of ascent with respect to the bottom 15 of the blade groove 11 is larger than the angle of ascent of the first portion. The guiding surface 13 ends in a bar part of the dam 12, the bar part being parallel to the bottom 15 of the blade groove 11, the bar part, in turn, ending in a rear part 14 of the dam 12, the rear part being perpendicular with respect to the bottom 15 of the blade groove 11.

The guiding surface 13 of the following dam 12 comprises two portions rising along an arched motion path. The first portion of the guiding surface 13 rises from the bottom 15 of the blade groove 11 along a concave motion path, and it is followed by a second portion that continues the rise of the guiding surface 13 along a convex motion path constituting a smooth flow path. The guiding surface 13 may rise up to 75 percent, for example, of the height of the blade bar. The guiding surface 13 ends in the rear part 14 of the dam 12, the rear part being perpendicular with respect to the bottom 15 of the blade groove 11.

The guiding surface 13 of the following dam 12 rises linearly at a constant angle and starts from the bottom 15 of the blade groove 11. The linearly rising guiding surface 13 ends in the rear part 14 of the dam 12, the rear part descending linearly at a constant angle to the bottom 15 of the blade groove 11, in such a manner that, viewed from the side, the shape of the dam resembles the shape of a pyramid. Such a rear part 14 of a dam 12 is a preferable solution when the material refined and to be refined is expected to move on the refining surface 2 of the stator somewhat also from the direction of the feed edge 17 of the refining surface 2 in the direction of the discharge edge 16.

The guiding surface 13 of the following dam 12 rises along a convex motion path and starts from the bottom 15 of the blade groove 11. The guiding surface 13 that rises along a convex motion path ends in the rear part 14 of the dam 12, the rear part being perpendicular with respect to the bottom 15 of the blade groove 11.

The guiding surface 13 of the last dam 12 rises linearly from the direction of the bottom 15 of the blade groove 11, but said guiding surface 13 does not rise starting from the bottom 15 of the blade groove 11, but from some height between the bottom 15 of the blade groove 11 and the height of the blade bar. The linearly rising guiding surface 13 ends in the rear part 14 of the dam 12, the rear part being perpendicular with respect to the bottom 15 of the blade groove 11.

Accordingly, the guiding surface 13 of the dam 12 may comprise one or more portions, whereby said portions may be linear, convex or concave or combinations thereof also in other manners than shown in FIG. 10.

Dams 12 of the described type may be situated in the blade groove of the refining surface of one or more refiner stators. Thus, at least one blade groove of the refining surface of a refiner stator may have at least one or more dams of the described type. It is also feasible that all dams in at least one blade groove are according to what was described above. It is also feasible that all blade grooves of a refining surface of a refiner stator have one or more dams of the described type. Accordingly, it is feasible that even all dams of the refining surface of a stator are according to what was described above. It is also feasible that the dam as described above is arranged in only some blade grooves of the refining surface of a refiner stator, the other blade grooves being either without dams or comprising previously known dam structures.

The dam 12 extends to a height of at least 25% of the height of the blade bar starting from the bottom 15 of the blade groove. The dam preferably extends to a height of at least 50% of the height of the blade bar starting from the bottom of the blade groove. More preferably, the dam extends to a height of at least 75% of the height of the blade bar starting from the bottom of the blade groove. Most preferably, the dam extends up to the blade surface, i.e. to the height of the blade bar starting from the bottom of the blade groove. The length of the dams 12 in the direction of the bottom 15 of the blade groove 11 depends on the above-mentioned height and angle of ascent of the dam.

In some cases, the features disclosed in the present application may be used as such, irrespective of other features. On the other hand, if need be, the features disclosed in the present application may be combined to generate different combinations.

The drawings and the related description are only intended to illustrate the idea of the invention. The details of the invention may vary within the scope of the claims.

The invention claimed is:

1. A refining surface of a refiner stator for a refiner used for defibrating high consistency lignocellulose-containing material, the refining surface comprising;

wherein the refining surface has a feed edge arranged to be connected to a source of lignocellulose-containing material of more than 25% consistency, and a discharge edge arranged to discharge lignocellulose-containing material;

wherein the feed edge and the discharge edge define a direction toward the discharge edge which extends from the feed edge to the discharge edge;

wherein the feed edge and the discharge edge define a refining surface length between the feed edge and the discharge edge along the refining surface and in the direction toward the discharge edge;

wherein the refining surface has portions defining a plurality of blade bars and blade grooves between the bars, the blade bars and blade grooves extending in the direction toward the discharge edge;

wherein the blade grooves of the refining surface have portions defining blade groove bottoms;

wherein the refining surface has portions defining a plurality of first dams arranged in the blade grooves, the first dams having guiding surfaces which rise upward toward the blade bars from the bottoms of the blade grooves in a direction opposite the direction toward the discharge edge;

wherein the first dams are arranged over at most 75% of the refining surface length starting from the feed edge of the refining surface in the direction of the discharge edge of the refining surface, said at most 75% of the refining surface length defining a first portion;

wherein the refining surface has portions defining a plurality of second dams arranged in the blade grooves, the second dams having guiding surfaces which rise upward toward the blade bars from the bottoms of the blade grooves in the direction toward the discharge edge; and wherein the second dams are arranged over the refining surface which is not of part of the first portion of the refining surface length.

2. The refining surface of claim 1 wherein a portion of the refining surface forms a source of steam and said first dams are arranged between the source of steam and the feed edge of the refining surface.

3. The refining surface of claim 1 wherein the first dams are arranged over at most 50% of the refining surface length starting from the feed edge of the refining surface in the direction of the discharge edge of the refining surface.

4. The refining surface of claim 1 wherein the refiner stator defines a center, and an outer circumference, so that the refiner stator has a center side and an outer circumference side, the refining surface further comprising:

an inner blade block and an outer blade block, the inter blade block starting from the feed edge positioned on a side adjacent the center of the refiner stator, and an outer blade block placed on the outer circumference side of the refiner stator, and ending in the discharge edge, wherein the inner blade block is adjacent the outer blade block; and wherein the inner blade block has only first dams.

5. The refining surface of claim 4 wherein the inner blade block is planar, and forms a planar part of the refining surface, and the outer blade block is conical, and forms a conical part of the refining surface.

6. The refining surface of claim 5 wherein first dams on the conical part of the refining surface of the outer blade block are arranged over at most 50% of that part of the refining surface length which runs along the conical part of the refining surface starting from an edge defined between the inner blade block and the outer blade block.

7. The refining surface of claim 5 wherein first dams on the conical part of the refining surface of the outer blade block are arranged over at most 25% of that part of the refining surface length which runs along the conical part of the refining surface starting from an edge defined between the inner blade block and the outer blade block.

8. The refining surface of claim 2, wherein a portion of the refining surface between the source of steam and the discharge edge is provided with the second dams.

9. The refining surface of claim 1, wherein the guiding surface of the first dams or second dams has at least one linearly rising portion, and at least one portion rising along a convex motion path or at least one portion rising along a concave motion path.

10. The refining surface of claim 1, wherein the blade bars extend to a first height, and the first dams and the second dams extend to the first height of the blade bars.

11. A blade segment configurable to constitute a part of a refining surface of a stator of a high-consistency refiner for defibrating lignocellulose-containing material, the blade segment comprising:

a segment of a refining surface having a feed edge arranged to be connected to a source of lignocellulose-containing material of more than 25% consistency, and a discharge edge arranged to discharge lignocellulose-containing material;

wherein the feed edge and the discharge edge define a direction toward the discharge edge which extends from the feed edge to the discharge edge;

wherein the feed edge and the discharge edge define a segment length between the feed edge and the discharge edge along the segment of a refining surface and in the direction toward the discharge edge;

wherein the refining surface has a plurality of blade bars and blade grooves between the blade bars, the blade bars and blade grooves extending in the direction toward the discharge edge;

wherein the blade grooves of the refining surface define blade groove bottoms;

wherein the segment of a refining surface has a plurality of first dams arranged in the blade grooves, the first dams having guiding surface which rise upward toward blade bars from the bottom of the blade grooves in a direction opposite the direction toward the discharge edge;

wherein the first dams are arranged over at most 75% of the segment length starting from the feed edge of the refining surface in the direction of the discharge edge of the refining surface, said at most 75% of the segment length defining a first portion;

wherein the refining surface forms a plurality of second dams arranged in the blade grooves, the second dams having guiding surfaces which rises upward toward blade bars from the bottom of the blade grooves in the direction toward the discharge edge; and wherein the second dams are arranged over the segment of a refining surface which is not of the first portion of the segment length.

12. The blade segment of claim 11 wherein a portion of the segment of a refining surface forms a source of steam and said first dams are arranged between the source of steam and the feed edge of the segment of a refining surface.

13. The blade segment of claim 11 wherein the first dams are arranged over at most 50% of the segment of a refining surface length starting from the feed edge of the segment of a refining surface in the direction of the discharge edge of the segment of a refining surface.

14. The blade segment of claim 11 wherein the blade segment is planar.

15. The blade segment of claim 11 wherein the segment is conical and wherein the first dams on the conical segment are arranged over at most 50% of the segment of a refining surface length.

16. The blade segment of claim 11 wherein the segment is conical and wherein the first dams on the conical segment are arranged over at most 25% of the segment of a refining surface length.

17. The blade segment of claim 11, wherein each guiding surface of the first dams or second dams has at least one linearly rising portion, and at least one portion rising along a convex motion path or at least one portion rising along a concave motion path.

18. The blade segment of claim 11, wherein the blade bars have a height, and wherein the first dams and second dams extend to the height of the blade bars.

19. A refiner for defibrating lignocellulose-containing material, comprising;

a refiner chamber;

a refiner rotor mounted for rotation about a center on a shaft within the refiner chamber, the refiner rotor having a first refining surface;

a refiner stator mounted to the refiner chamber, the refiner stator having a second refining surface;

wherein the first refining surface has a feed edge connected to a source of lignocellulose-containing material of more than 25% consistency, and a discharge edge arranged to discharge lignocellulose-containing material;

wherein the feed edge, and the discharge edge define a direction toward the discharge edge which extends from the feed edge to discharge edge;

wherein the feed edge and the discharge edge define a refining surface length between the feed edge and the discharge edge along the direction toward the discharge edge;

wherein the refining surface has blade bars and blade grooves therebetween which extend in the direction toward the discharge edge;

wherein the blade grooves of the refining surface define blade groove bottoms;

wherein the refining surface has a plurality of first dams arranged in the blade grooves, the first dams having guiding surfaces which rise upward toward the blade bars from the bottom of the blade grooves in a direction opposite the direction toward the discharge edge;

wherein the first dams are arranged over at least 25% and at most 75% of the refining surface length starting from the feed edge of the refining surface and extending in the direction of the discharge edge of the refining surface said over at least 25% and at most 75% of the refining surface length defining a first portion;

wherein the refining surface forms a plurality of second dams arranged in the blade grooves, the second dams having guiding surfaces which rise upward toward the blade bars from the bottom of the blade grooves in the direction toward the discharge edge; and wherein the second dams are arranged over the refining surface which is not part of the first portion of the refining surface length.

20. The refiner of claim 19 wherein the second refining surface is formed by a plurality of parts, arranged radially outwardly from the center.

21. The refiner of claim 19 wherein the second refining surface is formed of a plurality of circumferentially arranged parts.

22. The refiner of claim 21, wherein the blade bars extend to a height, and wherein the first dams and the second dams extend to the height of the blade bars.

23. A refiner for defibrating lignocellulose-containing material, comprising;

a refiner chamber;

a refiner rotor mounted for rotation about a center on a shaft within the refiner chamber, the refiner rotor having a first refining surface;

a refiner stator mounted to the refiner chamber, the refiner stator having a second refining surface;

wherein the first refining surface has a feed edge arranged to be connected to a source of lignocellulose-containing material of less than 8% consistency, and a discharge edge arranged to discharge lignocellulose-containing material;

wherein the feed edge and the discharge edge define a direction toward the discharge edge which extends from the feed edge to the discharge edge;

wherein the feed edge and the discharge edge define a refining surface length between the feed edge and the discharge edge along the direction toward the discharge edge;

wherein the refining surface has portions defining blade bars and blade grooves therebetween which extend in the direction toward the discharge edge;

wherein the blade grooves of the refining surface define blade groove bottoms;

wherein the refining surface has dams arranged in the blade grooves, the dams having guiding surfaces which rise upward toward blade bars from the bottom of the blade grooves in a direction opposite the direction toward the discharge edge;

wherein the dams are arranged over at least 25% and at most 75% of the refining surface length starting from the discharge edge of the refining surface in the direction of the feed edge of the refining surface.

24. The refiner of claim 23 wherein the blade bars have a height and wherein the dams extend to the height of the blade bars.

* * * * *